United States Patent [19]

Long

[11] Patent Number: 4,805,366

[45] Date of Patent: Feb. 21, 1989

[54] SNAPLOCK RETAINER MECHANISM FOR INSULATED WALL CONSTRUCTION

[75] Inventor: Robert T. Long, Ames, Iowa

[73] Assignee: Thermomass Technology, Inc., Ames, Iowa

[21] Appl. No.: 134,744

[22] Filed: Dec. 18, 1987

[51] Int. Cl.[4] ..... E04C 2/26; E04C 5/18

[52] U.S. Cl. ..... 52/309.11; 52/309.12; 52/250; 52/268; 52/410; 52/712; 52/714; 249/40; 249/41; 249/213; 249/218; 411/339; 411/510

[58] Field of Search ..... 52/309.11, 309.12, 410, 52/712–714, 715, 309.4, 309.7, 309.17, 250, 268, 378; 249/40–43, 96, 97, 213–218, 219.1, 219.2; 411/338, 339, 510, 512, 533, 588; 405/259–261, 227

[56] References Cited

U.S. PATENT DOCUMENTS

| | | | |
|---|---|---|---|
| 2,645,929 | 7/1953 | Jones | 52/713 X |
| 2,775,018 | 12/1956 | McLaughlin | 249/41 X |
| 3,274,680 | 9/1966 | Cruse | 249/216 X |
| 4,329,821 | 5/1982 | Long et al. | 52/309.12 |
| 4,348,847 | 9/1982 | Jukes | 52/713 X |
| 4,393,635 | 7/1983 | Long | 52/309.11 |
| 4,545,163 | 10/1985 | Asselin | 52/410 X |
| 4,624,089 | 11/1986 | Dunker | 52/410 |
| 4,702,053 | 10/1987 | Hibbard | 52/309.12 X |

*Primary Examiner*—David A. Scherbel
*Assistant Examiner*—Richard E. Chilcot, Jr.
*Attorney, Agent, or Firm*—Hill, Van Santen, Steadman & Simpson

[57] ABSTRACT

An improved snap lock retainer mechanism for insulated wall construction apparatus for pouring a composite wall structure which includes a pair of outer poured concrete layers separated by a high density foam insulating panel mounted between the concrete layers and which includes a number of tying mechanisms for holding the insulated layer in place while the concrete is being poured and hardened wherein the holding means are formed of plastic rods upon which two plastic receivers are directly injection molded onto the rod. One of the receivers has a single notch and the other receiver has multiple notches. One of two snap rings which are identical goes first over the single notch receiver and is locked in place and then the rod is extended through the insulating panel and a second snap ring is attached to the multiple notches in a ratchet effect on the multiple notches plastic receivers so as to lock the board in place so that the concrete can be poured.

7 Claims, 1 Drawing Sheet

SNAPLOCK RETAINER MECHANISM FOR INSULATED WALL CONSTRUCTION

BACKGROUND OF THE INVENTION

1. Field of the Invention

The present invention relates to apparatus and means for constructing insulated walls wherein an inner insulating layer of high density polystyrene or other material is held in a form by low heat conductive rods so as to hold the insulation in place while concrete is being poured and also to assure that the finished wall has a very low heat conductivity so as to significantly reduce energy transfer.

2. Description of the Prior Art

My prior U.S. Pat. No. 4,393,635 discloses an insulated wall construction apparatus which has rods upon which holding spools are mounted so as to hold an insulating board in a form so that concrete can be poured on either side of the board. The rod and spool disclosed in U.S. Pat. No. 4,393,635 interlocked with a rod due to the opening configuration in the spool and the shape of the rod.

SUMMARY OF THE INVENTION

The present invention comprises an improvement in the structure of U.S. Pat. No. 4,393,635 which required that holes be bored through the foam insulation which had to be camphered so as to accept the plastic spool so that the rod could then be placed through the plastic spools on either side of the foam and given a quarter turn to lock them into place. The present invention comprises directly injection molding two plastic receivers onto the completed rod. One of the receivers has a single notch and the other one has multiple notches. One of two identical snap rings first goes over the single notch receiver and is locked in place. The placement of that particular receiver determines the relationship between the thickness of the wythe of the concrete, the foam and the other wythe of the concrete. After the first snaplock ring is placed upon a single notch receiver, the device is then passed through a predrilled hole in a foam board and then the other snaplock ring is attached to the multiple notches on the rod in a ratchet effect so as to lock the rod in the foam and to secure the system in the concrete foam at the appropriate location.

This results in a faster installation and an improved insulation over that disclosed in U.S. Pat. No. 4,393,635.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

Figure 1:
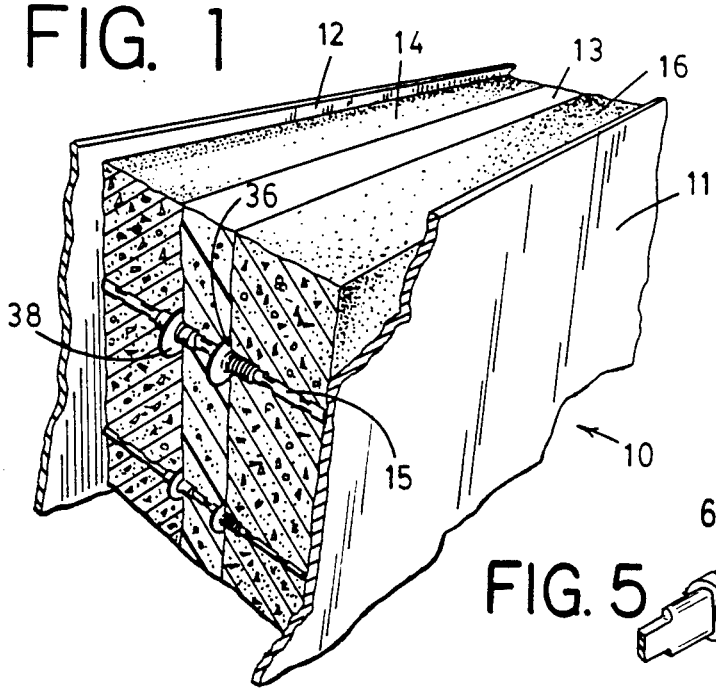
FIG. 1 is a cut-away perspective view of the invention in place.
Figure 3:
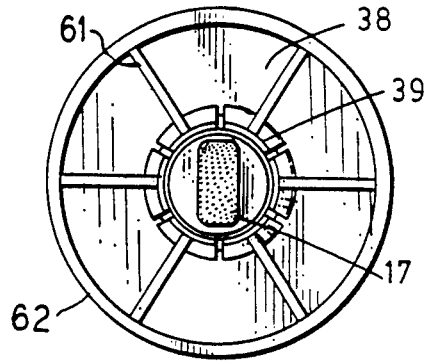
FIG. 3 is a sectional view through the rod.
Figure 2:
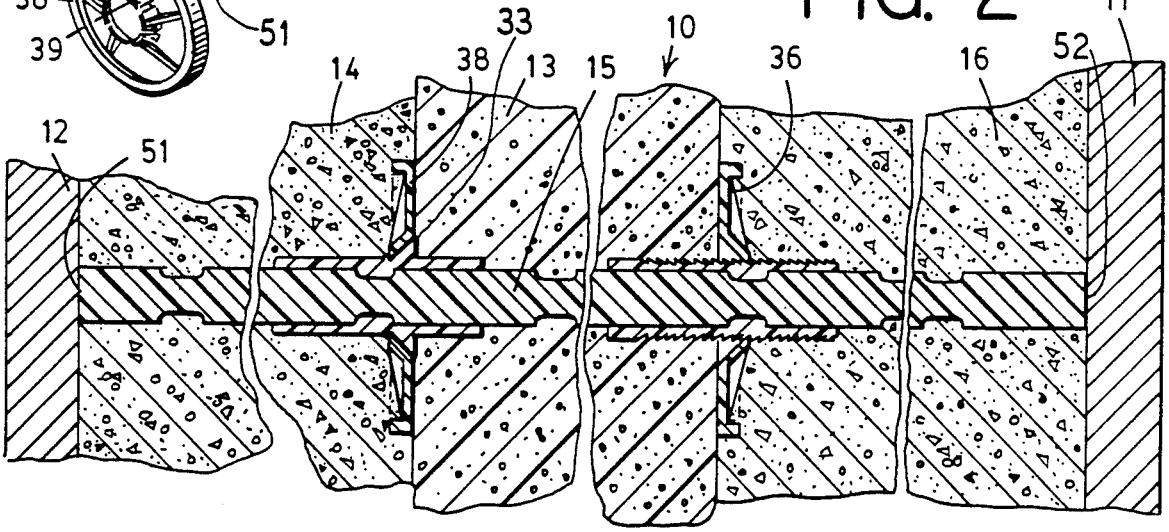
FIG. 2 is a sectional view of the invention.

As shown in FIGS. 1 and 2, a composite wall 10 is formed between two forms 11 and 12 between which is mounted a sheet of insulating material 13 which is held in place by rods 15 upon which are mounted snaprings 36 and 38. Concrete 14 and 16 is poured on opposite sides of the sheet 13 and is retained by the forms 11 and 12 to form the composite wall 10.

Figure 4:
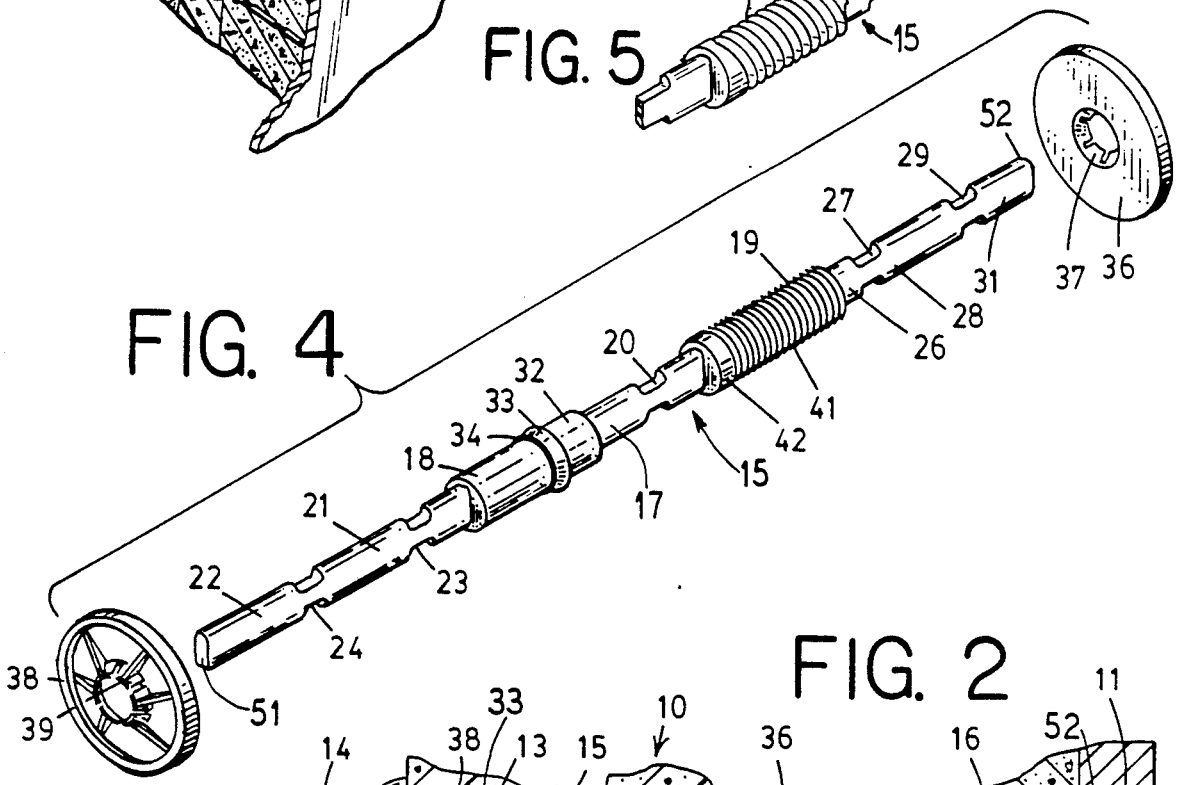
FIG. 4 is an exploded view of the rod and to snaplock retainer rings.

FIG. 2 is an enlarged sectional view through a rod 15 and the retaining discs 36 and 38 and illustrates how the ends 51 and 52 bear against the forms 11 and 12 to hold the sheet 13 in position. The rods 15 are formed of a plurality of sections as illustrated in FIG. 4 identified by numbers 22, 21, 17, 26, 28 and 31 which are separated by portions of reduced cross-sectional area identified by 24, 23, 20, 27 and 29. A first plastic receiver 18 is injection molded on the rod 15 at a first location such that it is locked to the rod and has a first cylindrical portion over which the first snap ring lock 38 is placed such that its fingers 39 are locked in groove 34 formed in member 18 and enlarged ring portion 33 bears against the other side of the ring 38 so as to lock it firmly and immoveably on the member 18.

A second plastic receiver 19 is injection molded on the rod 15 and is displaced from the receiver 18 and is formed with a shoulder 42 on one end thereof and is formed with multiple notches 41 on its main body portion.

Figure 5:
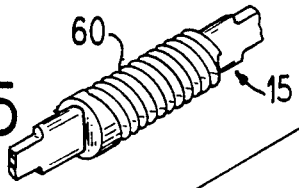
FIG. 5 is a modification of the invention.

A second snaplock ring 36 is formed with a conical finger portion 37 and is receivable over the rod 15 and the member 19 and the fingers 37 can be moved and locked in different positions in the notches 41 and the end of the fingers 37 are locked by the notches 41. Instead of notches 41 high helix threads may be used to facilitate tightening and/or positioning of the ring 36 which could be threadedly received on the helix. FIG. 5 illustrates the threads 60 on this embodiment. The rings 36 and 38 may have reinforcing ribs 61 to strengthen them. Also, a flange 62 may be formed at the outer edges of rings 36 and 38.

In operation, the snap ring 38 is placed over the rod 15 and the member 18 until its fingers 39 lock in the notch 34 and the enlarged ring portion 33 engages the ring 38 to lock it in place on the member 18.

After the ring 38 is placed upon the single notch receiver 18, the other end 52 of the rod 15 is passed through a predrilled hole formed in the foam board 13 and then the second snaplock ring 36 is passed over the rod 15 such that its fingers 37 lock in one of the notches 41 of the member 19 so as to lock the rod 15 in the foam 13 and to secure the system in the concrete form at the appropriate location.

As indicated in FIG. 1, a number of the rods 15 are mounted in the foam board 13 so as to hold it in the proper location between the forms 11 and 12.

It is seen that the present invention provides a new and novel rod and snap ring structure for supporting foam board 13 between a pair of forms 11 and 12 so that concrete can be poured on either side thereof to form a composite wall.

Testing has confirmed the existance of a thermal anomoly now known as thermal short-circuit during full scale tests of wall panels. Said phenomenon exists in any building system where highly conductive or non-insulating material tranverses a layer of insulation in an insulated building system.

Exhaustive testing was conducted at CTL labs, Skokie, Ill. on fiber components and systems with metal components and said testing confirmed and substantiates the phenomemon of this invention and that the rod mechanism does not represent a "short-circuit" in building system.

Although the invention has been described with respect to preferred embodiments, it is not to be so limited as changes and modifications may be made therein which are within the full intended scope as defined by the appended claims.

I claim as my invention:

1. An insulating wall comprising two spaced outer layers of form-poured concrete; an insulating, interior layer disposed between said outer layers; a plurality of rods extending perpendicularly through said insulating layer and further extending to respective outer surfaces of said outer layers; and a plurality of retainer means mounted to receive and immovably hole one of said rods for fixing the lateral position of said rods with respect to said insulation layer, whereby said rods abut a form during pouring of said concrete to retain said interior layer substantially immovably during pouring and are retained in said concrete after curing for forming a mechanical connection between said interior layer and each of said outer layers, wherein said retainer means comprises a pair of snap rings for each of said rods each formed with an outer flange and a central opening surrounded by flexible finger means, each of said rods formed with a first notched engaging portion upon which a first one of said pair of snap rings can be locked in a fixed position, said rod formed with a second engaging portion which is longitudinally offset from said first notched engaging portion and a second one of said pair of snap rings receivable on said rod and lockable to said second engaging portion.

2. An insulating wall according to claim 1 wherein said rods extend through said insulating layer and said first and second snap rings are mounted on opposite sides of said insulating board.

3. An insulating wall according to claim 2 wherein said second notched engaging portion is formed with a plurality of longitudinally spaced notches so that said second snap ring can be locked in different positions on said second engaging portion.

4. An insulating wall according to claim 3 wherein said first and second engaging portions are injection molded onto said rod.

5. An insulating wall according to claim 3 wherein said first and second engaging portions are generally cylindrically shaped.

6. An insulating wall according to claim 1 wherein said second engaging portion is formed with threads.

7. An insulating wall according to claim 1 wherein said second engaging is formed with a series of parallel annular grooves.

* * * * *